US008161931B2

(12) United States Patent
Geyer

(10) Patent No.: US 8,161,931 B2
(45) Date of Patent: Apr. 24, 2012

(54) METHOD FOR OPERATING AN INTERNAL COMBUSTION ENGINE

(75) Inventor: Klaus Geyer, Sulzbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 84 days.

(21) Appl. No.: 12/871,951

(22) Filed: Aug. 31, 2010

(65) Prior Publication Data

US 2011/0056451 A1 Mar. 10, 2011

(30) Foreign Application Priority Data

Sep. 5, 2009 (DE) ..... 10 2009 040 321

(51) Int. Cl.
*F02M 99/00* (2006.01)
*F02N 19/00* (2010.01)

(52) U.S. Cl. ..... 123/179.16; 701/104

(58) Field of Classification Search ..... 123/179.16, 123/185.1, 185.2, 185.3; 701/104, 113
See application file for complete search history.

(56) References Cited

U.S. PATENT DOCUMENTS

| | | | | |
|---|---|---|---|---|
| 5,752,488 | A * | 5/1998 | Hattori et al. | 123/179.16 |
| 6,523,528 | B1 * | 2/2003 | Wolters | 123/527 |
| 6,708,661 | B1 * | 3/2004 | Aubourg et al. | 123/179.16 |
| 2004/0168510 | A1 * | 9/2004 | Wakahara et al. | 73/118.1 |
| 2006/0070594 | A1 * | 4/2006 | Pattullo | 123/185.2 |

* cited by examiner

*Primary Examiner* — Stephen K Cronin
*Assistant Examiner* — Arnold Castro
(74) *Attorney, Agent, or Firm* — Gudrun E. Huckett

(57) ABSTRACT

In a method for operating an internal combustion engine that has a starter device for starting the internal combustion engine and a device for supplying fuel controlled by a control device, it is determined whether cold start conditions or hot start conditions exist during starting of the internal combustion engine. In at least one operating range, during starting of the internal combustion engine, an engine speed gradient is determined during a slowdown phase of a pull stroke of a starter device and the engine speed gradient is used for determining whether cold start conditions or hot start conditions exist. The fuel quantity to be supplied to the internal combustion engine is controlled based on the determined cold start conditions or hot start conditions.

11 Claims, 2 Drawing Sheets

METHOD FOR OPERATING AN INTERNAL COMBUSTION ENGINE

BACKGROUND OF THE INVENTION

The invention relates to a method for operating an internal combustion engine comprising a starter device for starting the internal combustion engine and a device for supplying fuel that is controlled by a control device wherein, when starting the internal combustion engine, it is determined whether cold start conditions or hot start conditions exist and the quantity of supplied fuel is controlled based on the determined start conditions.

Internal combustion engines used in hand-held power tools, for example, motor chain saws, cut-off machines, trimmers or the like, are operated under various ambient conditions. In order to ensure that the engine starts without problems in very cold weather as well as in very hot weather, it is known to determine the ambient temperature by means of a temperature sensor upon starting the engine and to control the starting process accordingly.

When using a temperature sensor that measures the ambient temperature, the existing start conditions for the engine cannot always be correctly determined. This holds true primarily when the engine has been standing still only for a short period of time so that restarting the engine should be carried out under hot start conditions; however, the ambient temperature is very low and the temperature sensor therefore determines cold start conditions. Starting the internal combustion engine under erroneously detected cold start conditions can lead to supplying a fuel/air mixture that is too rich to the internal combustion engine so that restarting the engine is difficult.

SUMMARY OF THE INVENTION

It is an object of the present invention to provide a method for operating an internal combustion engine of the aforementioned kind with which starting of the internal combustion engine is reliably possible.

It has been found that the engine speed gradient, i.e., the drop of engine speed over time, during a slowdown phase of a pull stroke of the starter of an internal combustion engine allows to determine whether the internal combustion engine runs under cold start conditions or under hot start conditions. During the slowdown phase after the pull stroke, the internal combustion engine rotates independent of the starter device. The rate at which the engine speed decreases during this slowdown phase depends on the friction of the internal combustion engine that, in turn, depends on the temperature of the lubricating oil. Means for detecting the engine speed are usually present in internal combustion engines anyway so that the engine speed gradient can be determined without additional expenditure and can be utilized for determining the start conditions. In this way, the start behavior of the internal combustion engine can be improved in a simple way.

Advantageously, the starter device has a coupling device for realizing a detachable connection with a crankshaft of the internal combustion engine and the engine speed gradient is determined when the starter device is separated from the crankshaft. In this way, effects of the starter device on the engine speed gradient can be prevented. The starter device is advantageously a manually operated cable pull starter. However, it is also possible to provide an electric starter device as a starter that is switched off for a predetermined period of time so that a slowdown phase will result for detecting the engine speed gradient.

Expediently, the engine speed gradient is compared with a limit value for determining whether cold start conditions or hot start conditions are present. In this connection, the limit value must not be constant.

Advantageously, for determining the cold start conditions or hot start conditions a temperature is determined. The temperature is advantageously measured outside of the internal combustion engine, i.e., outside of cylinder and crank case, and is to be differentiated from the engine temperature. The temperature must not be the temperature that is measured outside of a power tool in which the internal combustion engine is arranged. A simple configuration is provided when the control device is an electronic control unit and the temperature is measured in the electronic control unit. The temperature sensor for detecting the temperature can therefore be directly arranged on the circuit board of the electronic control unit so that no wiring is required. The temperature that is measured in the electronic control unit is between the engine temperature and the ambient temperature. By measuring the temperature in the electronic control unit no external sensors are needed, i.e., sensors positioned outside of the electronic control unit. In this way, a simple configuration and simple assembly are provided.

It may be provided that the engine speed gradient is detected when the temperature is within a temperature range in which, based on the measured temperature, in particular the temperature in the electronic control unit, it is not possible to unequivocally determine whether cold start or hot start conditions exist. The engine speed gradient is determined therefore only when the determined temperature is insufficient for determining the start conditions. The operating range in which the engine speed gradient is detected is advantageously a temperature of approximately −10° C. to +20° C.

Advantageously, as a function of the detected start conditions a first quantity of supplied fuel for cold start conditions or a second quantity of supplied fuel for hot start conditions is selected.

Under cold start conditions, starting the engine with the first pull stroke of the starter is generally not possible. Is it is therefore provided that for the first pull stroke of the starter of the internal combustion engine a quantity of fuel to be supplied is selected that is used for hot start conditions. Under favorable conditions and when hot start conditions exist, starting the engine may be enabled with the first pull stroke. Upon the first pull stroke it is then determined whether cold start conditions or hot start conditions exist. Advantageously, a selected first fuel quantity to be supplied for cold start conditions remains in effect, i.e., continues to be supplied, until the internal combustion engine has been started and is running. When after cold start conditions have been determined subsequently hot start conditions are erroneously detected, it is still possible in this way to start the internal combustion engine.

DESCRIPTION OF THE PREFERRED EMBODIMENTS

Figure 1:
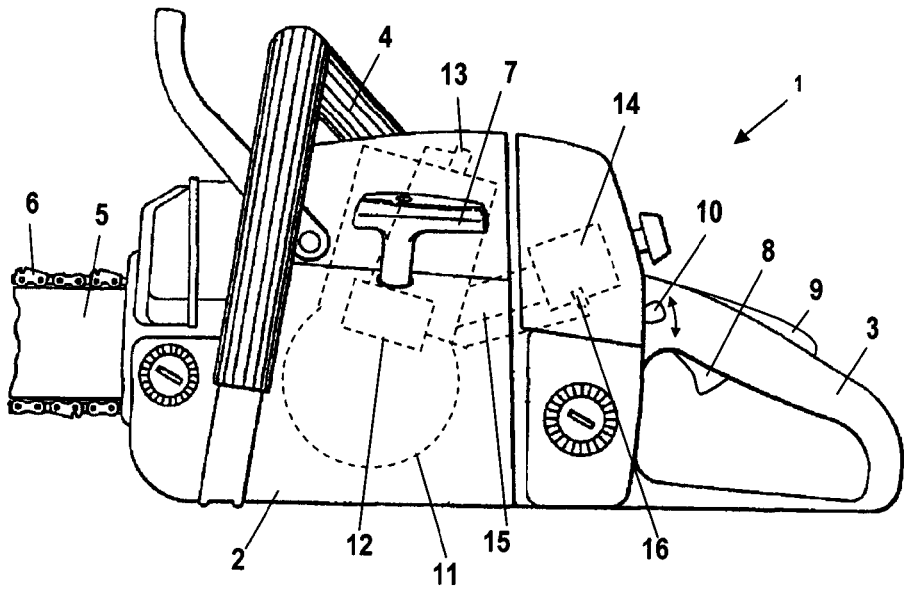
FIG. 1 is a schematic side view of a motor chain saw.

FIG. 1 is an embodiment of a hand-held power tool in the form of a motor chain saw 1. The method according to the invention can also be employed advantageously in internal combustion engines of other power tools, for example, a cut-off machine, a trimmer, a lawnmower or the like. Also, other applications may be expedient.

The motor chain saw 1 has a housing 2 on which a rear grip 3 is arranged. On the rear grip 3 a throttle lever 8 and a throttle lock 9 are pivotably supported. Adjacent to the rear grip 3 an operating mode selector 10 projects from the housing 2. By means of the operating mode selector 10, the motor chain saw 1 can be turned on and off. On the housing 2 there is also a grip pipe 4 for guiding the motor chainsaw 1 in operation. On the side of the housing 2 that is opposite the rear grip 3, a guide bar 5 projects forwardly on which the saw chain 6 is driven in circulation. The saw chain 6 is driven by an internal combustion engine 11 that is arranged in the housing 2 and is indicated in FIG. 1 in dashed lines. The handle 7 for actuating a starter device of the internal combustion engine 11 projects from the housing 2. The internal combustion engine 11 has an electronic control unit 12 that controls a spark plug 13 and a fuel valve 16. The fuel valve 16 opens in the illustrated embodiment in the area of a carburetor 14 into an intake passage 15 of the internal combustion engine 11. However, the fuel valve 16 can also open into a crankcase of the internal combustion engine 11. The fuel valve 16 is advantageously a solenoid valve.

Figure 2:
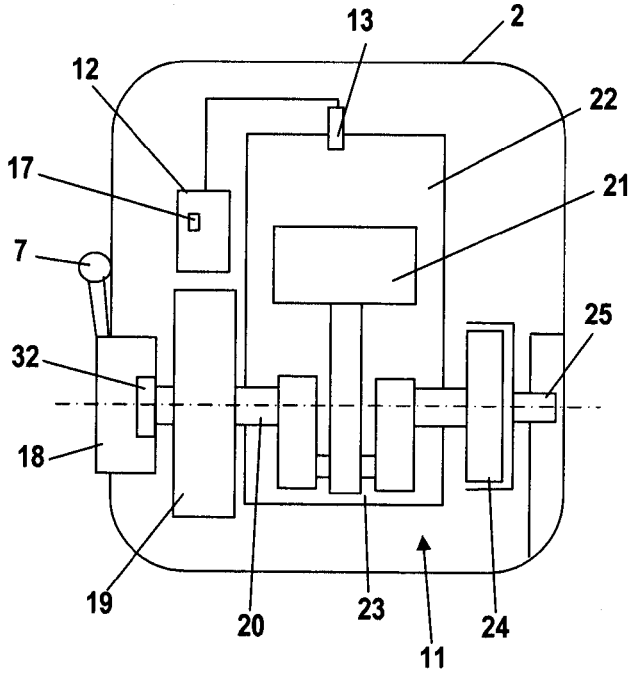
FIG. 2 is a schematic section illustration of a motor chain saw of FIG. 1.

In FIG. 2 the configuration of the drive of the motor chain saw 1 is illustrated in detail. As shown in FIG. 2, the spark plug 13 projects into a cylinder 22 of the internal combustion engine 11 in which a combustion chamber is formed that is delimited by a piston 21. The piston 21 drives a crankshaft 20 that is supported rotatably in the crankcase 23. On one side of the internal combustion engine 11 a fan wheel 19 is secured on the crankshaft 20; at its outer circumference the control unit 12 is arranged. The electronic control unit 12 can be, for example, an ignition device in which electric energy is induced by means of magnets that are secured on the fan wheel 19. For supplying the combustion engine 11 with energy, it is also possible to provide a generator, not illustrated, that is arranged on the crankshaft 20. As shown schematically in FIG. 2, in the electronic control unit 12 a temperature sensor 17 is arranged. The temperature sensor 17 is advantageously secured on a circuit board of the control unit 12.

On the side of the fan wheel 19 that is facing away from the internal combustion engine 11 a cable pull starter 18 is arranged as a starter device for the internal combustion engine 11; the starter 18 can be connected by means of a coupling device 32 to the crankshaft 20. On the side of the internal combustion engine 11 that is opposite the fan wheel 19 a centrifugal clutch 24 is provided that connects a drive pinion 25 for driving the saw chain 6 with the crankshaft 20.

For starting the internal combustion engine 11, the operator pulls on the handle 7 and causes in this way the coupling device 32 to rotate the crankshaft 20. Since a few revolutions of the crankshaft 20 are required until fuel finally reaches the combustion chamber and the internal combustion chamber 11 has sufficient kinetic energy in order to compress the mixture in the combustion chamber and to ignite it, only under very favorable conditions the internal combustion engine 11 will be started and running as a result of the first pull stroke. When with the first pull stroke of the handle 7 the internal combustion engine 11 has not yet been started, the operator will release the handle 7 that is then pulled back by a restoring spring into the housing 2. Subsequently, the operator can carry out a second pull stroke.

Figure 3:
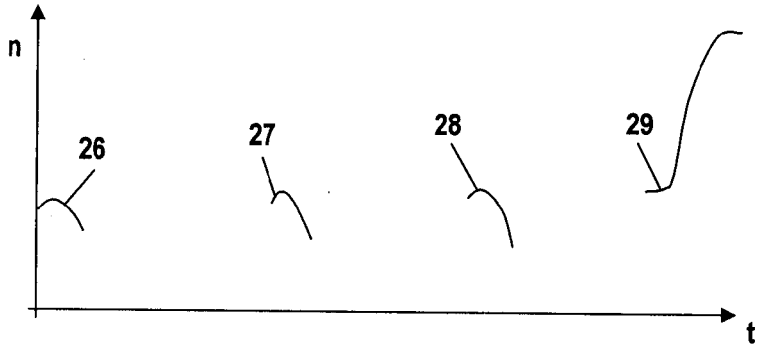
FIG. 3 is a diagram that illustrates a possible engine speed course over time when starting the engine.

FIG. 3 shows the course of the engine speed n plotted against the time t for several pull strokes. During the first pull stroke 26 the engine speed first increases and then drops again. The drop of the engine speed corresponds to the slowdown phase of the internal combustion engine 11 when the starter device 18 is no longer coupled by means of the coupling device 32 with the crankshaft 20. For the second pull stroke 27 and the third pull stroke 28 initially an increase of engine speed n will result that corresponds to the pulling-out action of the handle 7 and a subsequent engine speed drop occurs that corresponds to the slowdown of the crankshaft 20. Only at the time of the fourth pull stroke 29 the engine speed n rises significantly after the pull stroke. Here the engine has been started and is running.

In operation, the motor chain saw 1 can be operated under various ambient conditions. At very low temperatures, the internal combustion engine 11 must be supplied with more fuel for the starting process. In order to recognize the low ambient temperature, i.e., low temperatures outside of the engine itself, the temperature sensor 17 in the electronic control unit 12 is provided. However, the temperature sensor 17 can indicate very low temperatures even though the internal combustion engine 11 has already been operated, for example, when the housing 2 has already cooled down after shutting off the internal combustion engine 11 to the low ambient temperature but the internal combustion engine 11 is still completely lubricated. In this case, the internal combustion engine 11 should be started under hot start conditions even though the temperature sensor 11 in the control unit 12 indicates cold start conditions. In order to be able to differentiate between the hot start conditions and the cold start conditions more precisely, it is provided that the engine speed gradient $\Delta n$ during the slowdown phase of a pull stroke is determined.

Figure 4:
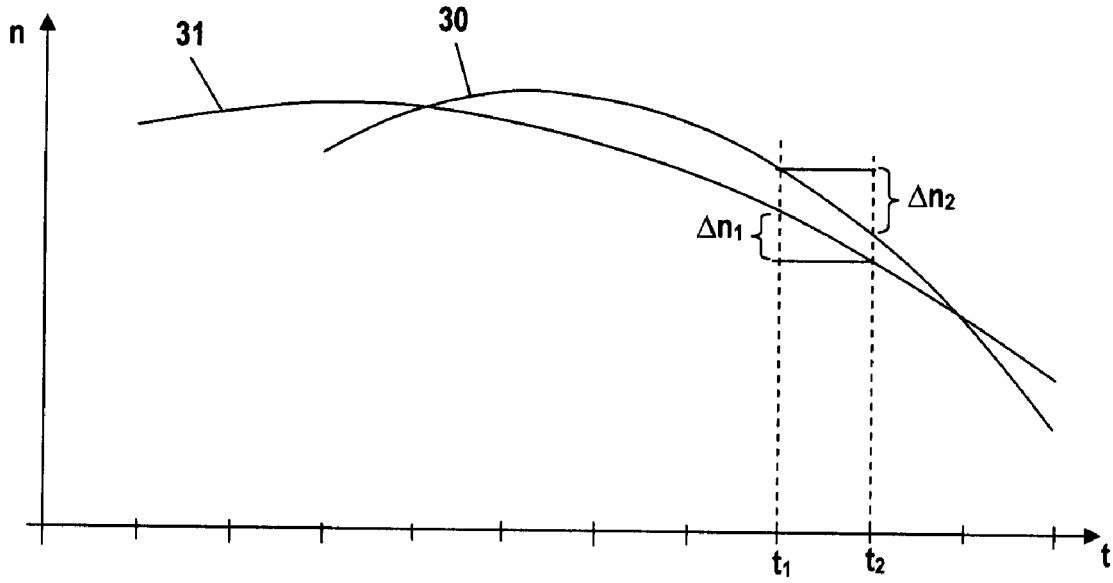
FIG. 4 is a detail illustration of a pull stroke of the diagram of FIG. 3.

The engine speed course during a pull stroke is indicated in detail in FIG. 4. The curve 30 indicates the engine speed course under cold start conditions and curve 31 the engine speed course under hot start conditions. The engine speed gradient is advantageously measured for one revolution of the crankshaft 20 and shortly before standstill of the crankshaft 20. In FIG. 4, the engine speed gradient is indicated between two points in time $t_1$ and $t_2$ and the spacing between $t_1$ and $t_2$ advantageously corresponds to one revolution of the crankshaft 20. In the curve 30 the engine speed gradient $\Delta n_2$ between the two points in time $t_1$ and $t_2$ is significantly greater than the engine speed gradient $\Delta n_1$ of the curve 31. Under cold start conditions, the crankshaft 20 as a result of greater friction is significantly braked or slowed down. This can be detected by means of the engine speed gradients $\Delta n_1$ and $\Delta n_2$.

Figure 5:
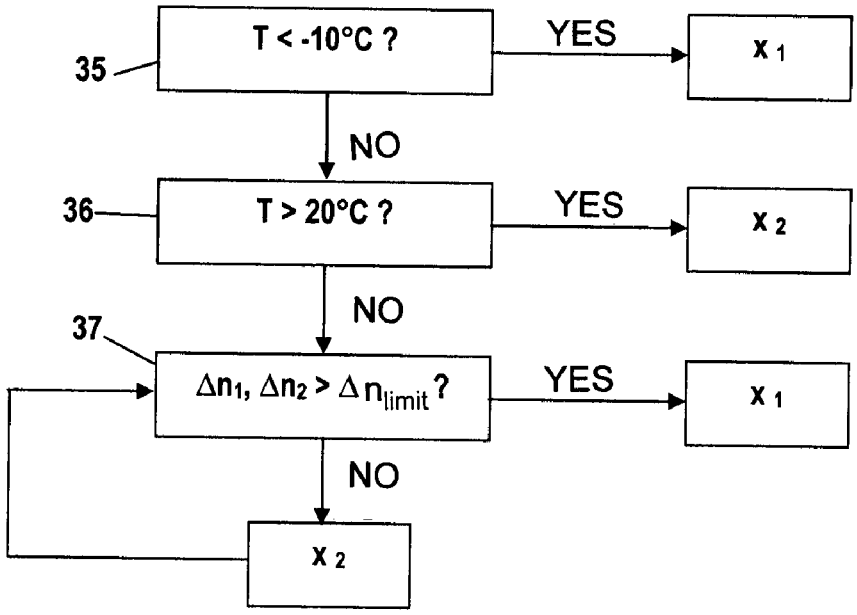
FIG. 5 is a flowchart illustration of the method.

FIG. 5 shows the course of a method for determining whether cold start conditions or hot start conditions exist. In the method step 35 it is checked first whether the temperature T measured in the electronic control unit 12 is smaller than a lower limit temperature, for example, −10° C. If this is the case, a first fuel quantity $x_1$ to be supplied for cold start conditions is selected. When the temperature is above −10° C., in the method step 36 it is determined whether the temperature T is below +20° C. The temperature T is measured by the temperature sensor 17. When the temperature is above +20° C., hot start conditions exist and a second fuel quantity $x_2$ to be supplied for hot start conditions is selected. The fuel quantities $x_1$ and $x_2$ can be selected as is conventional based on the fuel quantity per crankshaft revolution or by means of characteristic lines or maps or the like.

When the temperature T is between −10° C. and +20° C., in the method step 37 the engine speed gradient $\Delta n_1$, $\Delta n_2$ upon slowdown after a pull stroke is determined and compared to a limit value $\Delta n_{limit}$. When the engine speed gradient $\Delta n_1$, $\Delta n_2$ is above the limit value $\Delta n_{limit}$, cold start conditions exist and the first fuel quantity $x_1$ to be supplied is selected. This is indicated in the example according to FIG. 4 for the engine speed gradient $\Delta n_2$ for the curve 30. When the engine speed gradient $\Delta n_1$, $\Delta n_2$ is below the limit value $\Delta n_{limit}$, hot start conditions exist and the second fuel quantity $x_2$ to be supplied is selected. This is the case for the curve 31 and the engine speed gradient $\Delta n_1$. The selected fuel quantity $x_1$, $x_2$ is then supplied by appropriate control of the fuel valve 16. When cold start conditions are detected, the method is terminated until the internal combustion engine 11 has been started and is running. When hot start conditions are detected, for each further pull stroke the engine speed gradient is monitored in order to ensure that the hot start conditions have been detected correctly. If for a later pull stroke cold start conditions are detected, for the further pull strokes the first fuel quantity $x_1$ to be supplied for cold start conditions is then selected and the fuel is then supplied in accordance with fixed values or based on characteristic lines or maps.

The specification incorporates by reference the entire disclosure of German priority document 10 2009 040 321.3 having a filing date of Sep. 5, 2009.

While specific embodiments of the invention have been shown and described in detail to illustrate the inventive principles, it will be understood that the invention may be embodied otherwise without departing from such principles.

What is claimed is:

1. A method for operating an internal combustion engine, the internal combustion engine comprising a starter device for starting the internal combustion engine and a device for supplying fuel that is controlled by a control device; the method comprising the steps of:

determining whether cold start conditions or hot start conditions exist during starting of the internal combustion engine;

in at least one operating range, determining, during starting of the internal combustion engine, an engine speed gradient during a slowdown phase of a pull stroke of a starter device and utilizing the engine speed gradient for determining whether cold start conditions or hot start conditions exist;

controlling a fuel quantity to be supplied to the internal combustion engine based on the determined cold start conditions or hot start conditions.

2. The method according to claim 1, wherein the starter device comprises a coupling device that detachably connects the starter device with a crankshaft of the internal combustion engine, wherein the engine speed gradient is determined when the starter device is detached from the crankshaft by the coupling device.

3. The method according to claim 1, wherein the starter device is a cable pull starter that is actuated manually.

4. The method according to claim 1, comprising the step of comparing the engine speed gradient to a limit value for determining whether cold start conditions or hot start conditions exist.

5. The method according to claim 1, comprising the step of measuring a temperature for determining whether cold start conditions or hot start conditions exist.

6. The method according to claim 5, wherein the control device is an electronic control unit and the temperature is measured in the electronic control unit.

7. The method according to claim 5, wherein the engine speed gradient is determined when the temperature is within a temperature range in which, based on the temperature, a determination whether cold start conditions or hot start conditions exist cannot be made unequivocally.

8. The method according to claim 7, wherein the at least one operating range in which the engine speed gradient is determined is a temperature of approximately −10° C. to approximately +20° C.

9. The method according to claim 1, wherein, in the step of controlling the fuel quantity, for cold start conditions a first fuel quantity to be supplied is selected and for hot start conditions a second fuel quantity to be supplied is selected.

10. The method according to claim 9, wherein, when a first pull stroke of the starter device of the internal combustion engine is carried out for starting the internal combustion engine, the second fuel quantity for hot start conditions is selected.

11. The method according to claim 9, wherein the selected first fuel quantity to be supplied for cold start conditions continues to be supplied during starting of the internal combustion engine until the internal combustion engine is running.

* * * * *